US011439259B2

(12) United States Patent
Mess

(10) Patent No.: US 11,439,259 B2
(45) Date of Patent: Sep. 13, 2022

(54) SENSORY STRESS RELIEF AID

(71) Applicant: William Mess, Ocala, FL (US)

(72) Inventor: William Mess, Ocala, FL (US)

( * ) Notice: Subject to any disclaimer, the term of this patent is extended or adjusted under 35 U.S.C. 154(b) by 49 days.

(21) Appl. No.: 16/361,327

(22) Filed: Mar. 22, 2019

(65) Prior Publication Data

US 2019/0320827 A1 Oct. 24, 2019

Related U.S. Application Data

(60) Provisional application No. 62/659,846, filed on Apr. 19, 2018.

(51) Int. Cl.
*A47G 9/10* (2006.01)

(52) U.S. Cl.
CPC ..... *A47G 9/1045* (2013.01); *A47G 9/1027* (2013.01); *A47G 2200/143* (2013.01)

(58) Field of Classification Search
CPC ..... A47G 9/1045; A47G 9/1027; A47G 2200/143
See application file for complete search history.

(56) References Cited

U.S. PATENT DOCUMENTS 4,309,784 A * 1/1982 Cohen ..... A47G 9/0253 5/639
4,949,415 A * 8/1990 Selga ..... A47G 9/0207 40/124.01
4,989,285 A * 2/1991 Troncone ..... A47D 15/00 5/482
5,664,269 A * 9/1997 Broder ..... A47G 9/0207 5/482
5,830,109 A 11/1998 Juarez
5,898,962 A * 5/1999 McNeal ..... A47G 9/1045 5/639
6,327,725 B1 * 12/2001 Veilleux ..... A47G 9/0253 5/644
6,622,326 B2 * 9/2003 Richardson ..... A47C 27/081 5/636
6,908,662 B2 6/2005 Pearce
6,951,035 B2 10/2005 Kinchen et al.
8,628,067 B2 1/2014 Pearce et al.
2002/0095725 A1 * 7/2002 Dix ..... A47G 9/0223 5/482
2003/0159193 A1 * 8/2003 LeFevre ..... A47G 9/04 2/69.5

(Continued)

*Primary Examiner* — Eric J Kurilla
(74) *Attorney, Agent, or Firm* — Boudwin Intellectual Property; Daniel Boudwin

(57) ABSTRACT

A sensory stress relief aid designed to produce stress relief in a user. The sensory stress relief aid includes a pillow having a length and a width that define an outer layer. The outer layer of the pillow has a plurality of different surfaces disposed thereon, wherein each surface corresponds to a different tactile feel, such as velvet or fur. Additionally, the outer layer encloses a plurality of inner layers disposed within the pillow, wherein each inner layer comprises a different degree of firmness. A motor attached to an inflatable bladder disposed within the plurality of inner layers is configured to alternately inflate and deflate to simulate breathing. At least one speaking is included and adapted to emit soothing sounds such as nature noises and guided meditation instructions. A remote control in wireless communication with the motor and speakers allows a user to selectively operate each.

15 Claims, 5 Drawing Sheets

(56) References Cited

U.S. PATENT DOCUMENTS

2003/0188384 A1* 10/2003 Maldonado ..... A47G 9/10 5/636
2005/0120482 A1* 6/2005 Robie ..... A47G 33/00 5/639
2006/0277680 A1* 12/2006 Goetz ..... A47G 9/086 5/413 AM
2007/0061976 A1* 3/2007 Bazargani ..... A47G 9/1027 5/644
2009/0044336 A1* 2/2009 Jackson ..... A47G 9/0284 5/486
2010/0132231 A1* 6/2010 Kozel ..... A47C 31/123 40/1
2010/0263122 A1* 10/2010 Papen ..... A47G 9/0207 5/502
2011/0056021 A1* 3/2011 James ..... A47G 9/0207 5/502
2012/0073048 A1* 3/2012 Ballard ..... A47G 9/062 5/485
2012/0297541 A1* 11/2012 Brown ..... A47G 9/02 5/490
2013/0091632 A1 4/2013 Roban
2014/0018609 A1* 1/2014 Howard ..... A47D 15/00 600/28
2014/0189955 A1* 7/2014 Alletto, Jr. ..... A47G 9/0253 5/636
2014/0283722 A1* 9/2014 Pinoli ..... D05B 97/12 112/441
2015/0135442 A1* 5/2015 Deane ..... A47G 9/10 5/636
2015/0335853 A1* 11/2015 Orewiler ..... A41D 31/02 600/27
2016/0066716 A1* 3/2016 Rao ..... A61B 5/01 5/644
2017/0325606 A1* 11/2017 Robertson ..... A47G 9/1045
2017/0345427 A1* 11/2017 Hardman ..... G08C 17/02
2018/0063612 A1* 3/2018 Fuchs ..... H04R 5/023
2019/0045952 A1* 2/2019 Porter ..... A47G 9/007
2019/0059620 A1* 2/2019 Gosse ..... A47G 9/1027
2019/0182593 A1* 6/2019 Guerrini ..... H04R 1/26
2019/0307270 A1* 10/2019 Blum ..... A47G 9/1036
2019/0313718 A1* 10/2019 Voy ..... A45C 13/103
2019/0350389 A1* 11/2019 Sutton, Jr. ..... A47G 9/1045
2020/0288892 A1* 9/2020 Esser ..... A47G 9/1045
2020/0336010 A1* 10/2020 Holmvik ..... A47C 31/008

* cited by examiner

SENSORY STRESS RELIEF AID

CROSS REFERENCE TO RELATED APPLICATIONS

This application claims the benefit of U.S. Provisional Application No. 62/659,846 filed on Apr. 19, 2018. The above identified patent application is herein incorporated by reference in its entirety to provide continuity of disclosure.

BACKGROUND OF THE INVENTION

The present invention relates to stress relief aids. More specifically, the invention provides a sensory stress relief aid comprising a pillow having an outer layer with a plurality of different surfaces disposed thereon, wherein the outer layer is additionally configured to enclose a plurality of inner layers.

Many people suffer from a variety of intrusive or distracting thoughts throughout the day, causing them undue stress and preventing them from easily falling asleep at night. Although medication can help individuals cope with anxiety, not all medication is effective for all individuals. Similarly, meditation can aid users looking to relax, however meditation can be difficult to perform successfully. Thus, an improved sensory stress relief aid that can safely aid a user in relieving their stress by distracting their brain from intrusive thoughts is desired.

SUMMARY OF THE INVENTION

In view of the foregoing disadvantages inherent in the known types of sensory stress relief aids now present in the known art, the present invention provides a sensory stress relief aid wherein the same can be utilized for providing convenience for the user when desiring to use a pillow to aid them in meditation or relaxation.

The present system comprises a sensory stress relief aid. The sensory stress relief aid comprises a pillow having a length and a width that define an outer layer. The outer layer of the pillow has a plurality of different surfaces disposed thereon, wherein each surface corresponds to a different tactile sensation. Additionally, the outer layer encloses a plurality of inner layers disposed within the pillow, wherein each inner layer comprises a different degree of firmness thereby additionally producing a different tactile sensation when compressed. In this way, a user is able to use the sensory stress relief aid to distract their mind from intrusive thoughts and thereby relax. A motor attached to an inflatable bladder disposed within the pillow is configured to alternatively inflate and deflate while at least one speaker within the pillow is adapted to emit soothing sounds. A remote control in wireless communication with both the motor and speakers allows a user to selectively operate both features.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
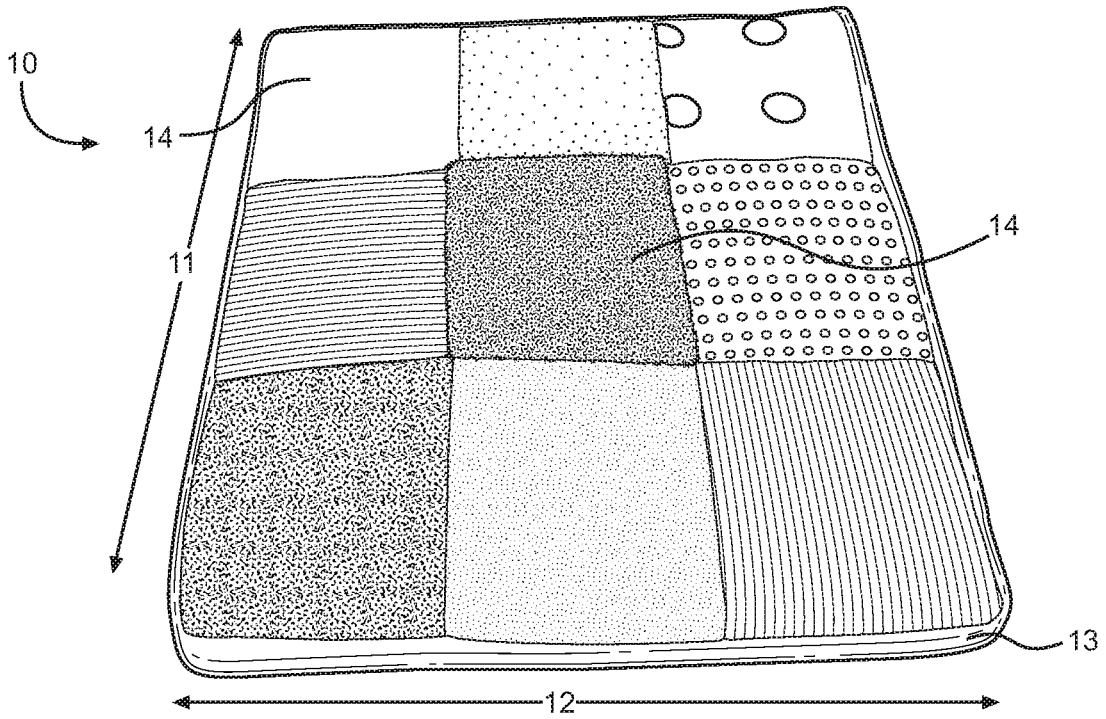
FIG. 1A shows a perspective view of an embodiment of the sensory stress relief aid.

Reference is made herein to the attached drawings. Like reference numerals are used throughout the drawings to depict like or similar elements of the sensory stress relief aid. The figures are intended for representative purposes only and should not be considered to be limiting in any respect.

Referring now to FIG. 1A, there is shown a perspective view of an embodiment of the sensory stress relief aid. A sensory stress relief aid comprises a pillow 10 having an outer layer 13 that encloses a plurality of inner layers. The pillow 10 has a length 11 and a width 12, wherein the width 12 is measured as a distance along the pillow 10 perpendicular to the length 11.

The outer layer 13 comprises at least one surface 14 disposed thereon. In the illustrated embodiment, the surfaces 14 are disposed such that they fully encompass the entire surface area of the outer layer 13, thereby ensuring the user can always find at least one surface 14. In the shown embodiment, the length 11 and width 12 are equivalent to one another, such that the pillow 10 is dimensioned as a square. In the illustrated embodiment, each of the plurality of surfaces 14 comprise the same surface area. Thus, the pillow 10 can be rotated to allow the user impartial access to each surface 14 disposed on the outer layer 13.

In the illustrated embodiment, the outer layer 13 comprises a total of nine unique surfaces 14 disposed thereon, such that the surfaces 14 are oriented in a grid like manner of three by three. In the illustrated embodiment, the surfaces 14 are repeated on an opposing side. In one embodiment where the user requests a number of surfaces 14 less than nine, the surfaces 14 are similarly disposed in a grid like orientation. However, in another embodiment the surfaces 14 are disposed to mirror their orientation across an axis disposed along the length 11 or across an axis disposed along the width 12. In other embodiments the length 11 is not equivalent to the width 12, such that the pillow 10 is dimensioned as a rectangle. In this way, the user is given greater access to a preferred surface 14 that is disposed along a width 12 or a length 11 of the pillow 10.

In the illustrated embodiment, each of the surfaces 14 comprises a different material, such as velvet or wool, such that each surface 14 gives the user a unique tactile experience. This allows the user to experience a variety of different surfaces 14 depending on their preference. However, in another embodiment, one or more surfaces 14 repeats, such that the user can experience their preferred surface 14 regardless of how the pillow 10 is oriented.

Figure 1B:
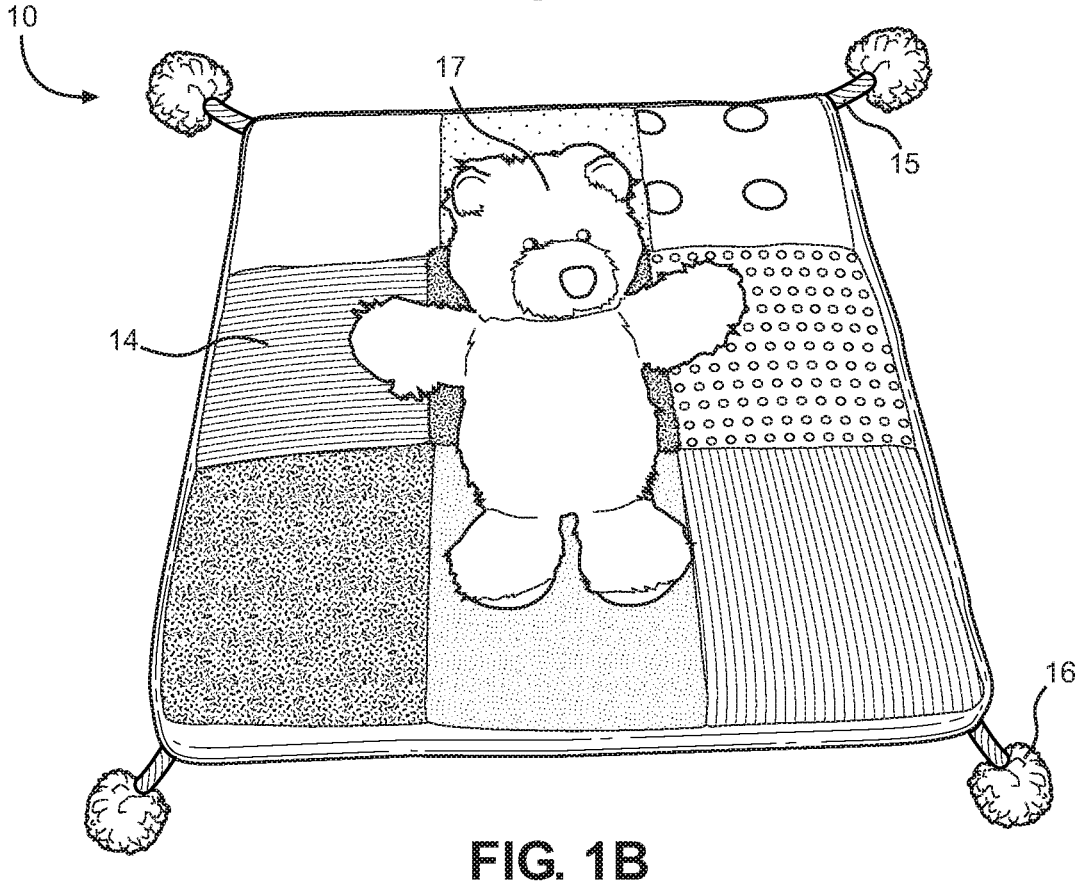
FIG. 1B shows a perspective view of an embodiment of the sensory stress relief aid having an indicium thereon.

Referring now to FIG. 1B, there is shown a perspective view of an embodiment of the sensory stress relief aid having an indicium thereon. In the illustrated embodiment, the sensory stress relief aid further comprises an indicium 17 disposed on the outer surface of the pillow 10. In the shown embodiment, the indicium 17 is composed of a material different from the plurality of surfaces 14 disposed across the outer surface of the pillow 10, such that the user can quickly identify the indicium with an associated surface 14, such as a teddy bear with soft fur. In the shown embodiment, the indicium 17 is configured to resemble a friendly figure, such that the user feels calmed by looking at the indicium 17 and feeling the surface 14 associated with the indicium 17.

In the shown embodiment, the sensory stress relief aid further comprises a tassel 15 protruding from each corner of the pillow 10 with a pom-pom 16 attached at a distal end thereof. The pom-poms 16 allow the user to grip and squeeze a small, spherical object within their hands, thereby allowing them additional stress relief. In the shown embodiment, the pom-poms 16 are all composed of the same material, such as yarn, wherein the material is different from the surfaces 14 disposed on the outer surface of the pillow 10. In the illustrated embodiment, the pom-poms 16 are affixed to the pillow 10 through the corresponding tassels 15. In this way, should the user provide excessive force to the pom-poms 16, the tassels 15 are configured to break and remove the pom-pom 16 from the pillow 10, thereby preventing damage to the surfaces 14 and pillow 10.

Figure 2A:
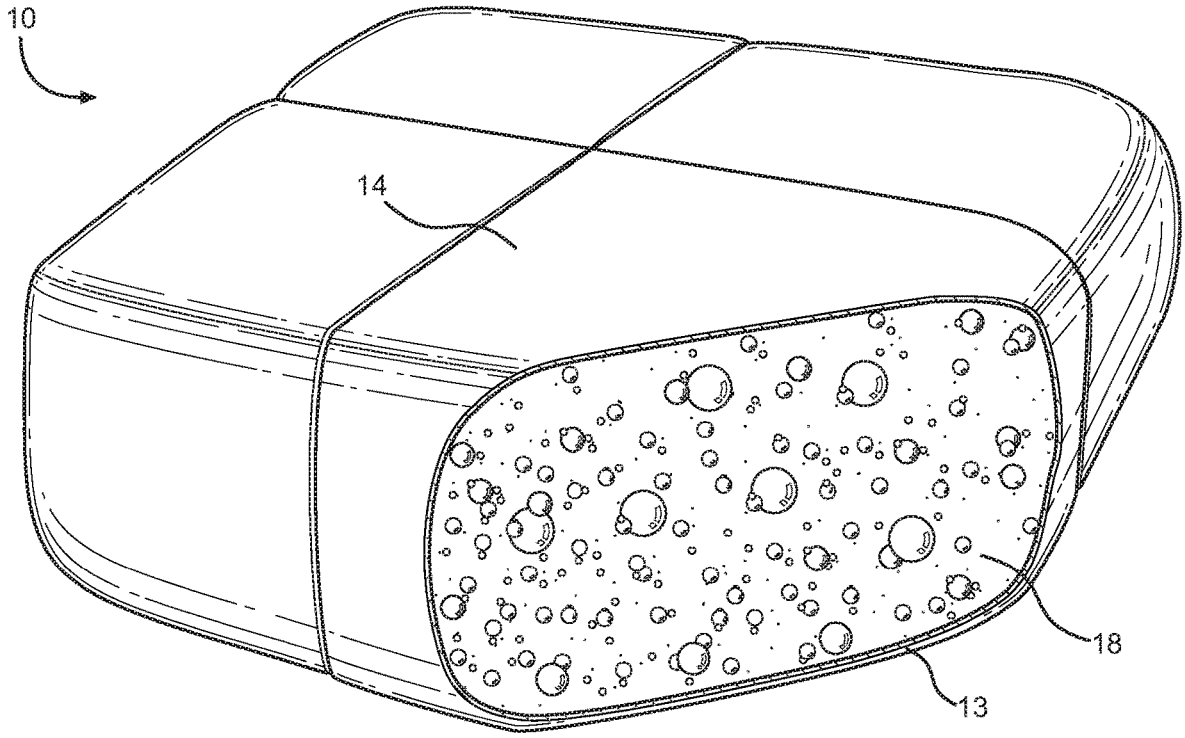
FIG. 2A shows a cross-sectional view of an embodiment of the sensory stress relief aid.
Figure 2B:
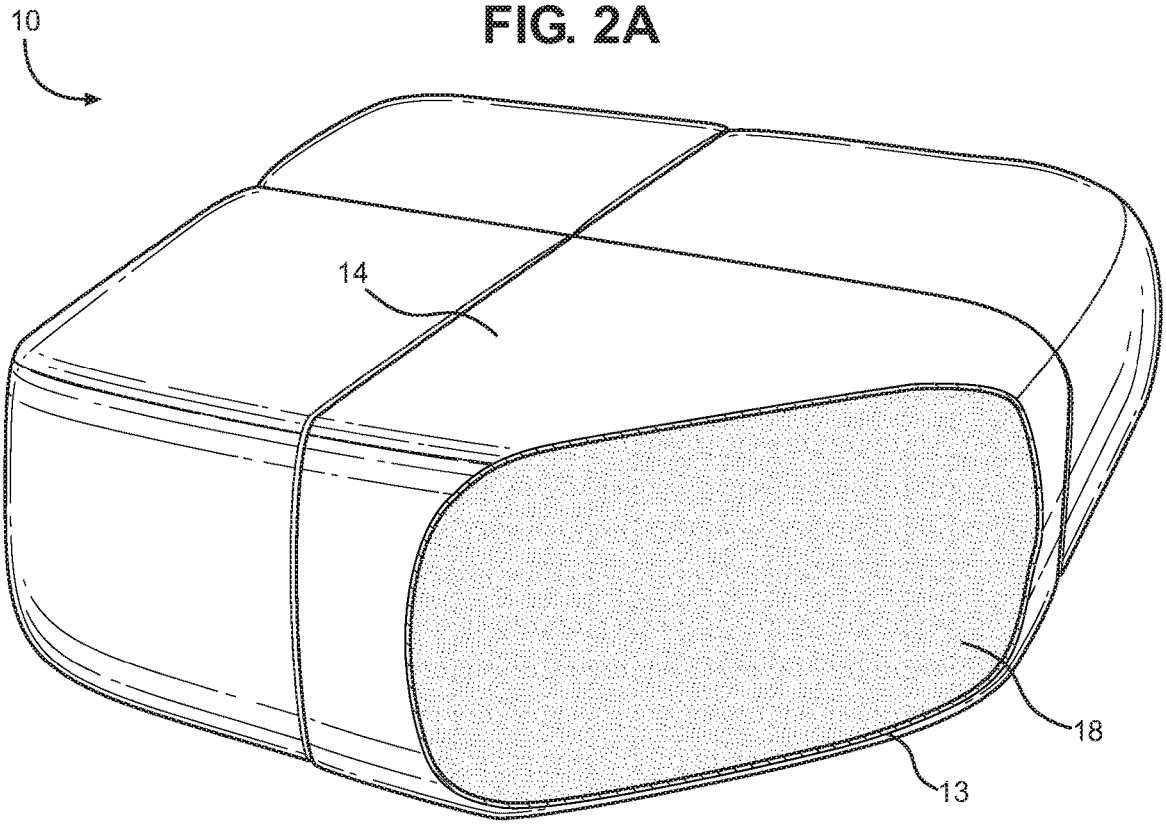
FIG. 2B shows another cross-sectional view of an embodiment of the sensory stress relief aid.

Referring now to FIGS. 2A and 2B, there are shown cross-sectional views of an embodiment of the sensory stress relief aid. The outer layer 13 of the pillow 10 encloses at least one inner layer 18 therein. In the illustrated embodiment, each inner layer 18 corresponds to a surface 14, such that there are an equivalent number of inner layers 18 which correspond to the number of surfaces 14, wherein each inner layer 18 is defined by a perimeter contiguous with a perimeter of the corresponding surface 14.

In the embodiment illustrated in FIG. 2A, the inner layer 18 comprises a gel layer that comprises a first level of firmness. In the embodiment illustrated in FIG. 2B, the inner layer 18 comprises a foam layer that comprises a second level of firmness, wherein the second level of firmness is greater than the first level of firmness. In this way, a plurality of differing firmness levels are disposed across the pillow 10 are a plurality of inner layers 18. In this way, the user can squeeze or compress the sensory stress relief aid on each surface 14 depending on their desired inner layer 18. In another embodiment, each inner layer 18 comprises a different firmness regardless of the variety of materials used, such that a plurality of densities are utilized.

Figure 3A:
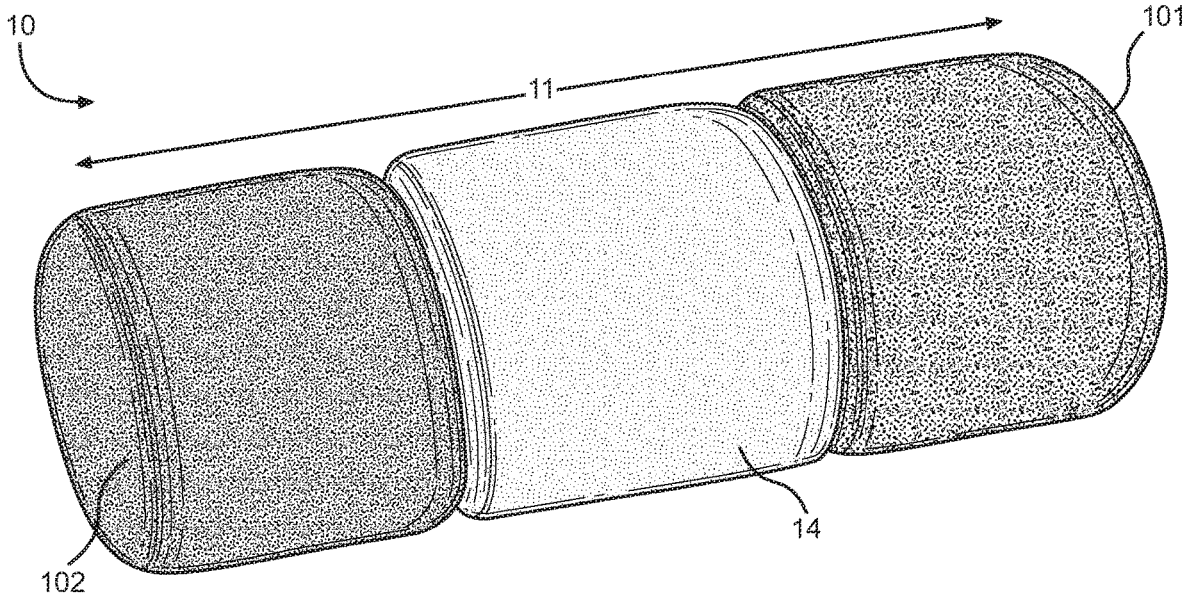
FIG. 3A shows a perspective view of an embodiment of the sensory stress relief aid as a cylindrical pillow.

Referring to FIG. 3A, there is shown a perspective view of an embodiment of the sensory stress relief aid as a cylindrical pillow. In one embodiment, the sensory stress relief aid comprises a cylindrical pillow 10, having a first end 101 and a second end 102, wherein the length 11 of the cylindrical pillow 10 corresponds to the distance between the first end 101 and the second end 102. In the shown embodiment, each surface 14 encompasses a portion of the cylindrical pillow 10 along a perimeter contiguous with a diameter of the cylindrical pillow 10. Thereby, the user can roll the cylindrical pillow 10 and continue to be provided with the consistent surface 14. The cylindrical pillow 10 allows an individual to use the sensory stress relief aid as a lumbar support or as a body pillow to provide a greater level of physical comfort when stressed. As such, the size of the cylindrical pillow 10 varies depending on the intended use and size of user and is dimensioned appropriately for a child or an adult.

Figure 3B:
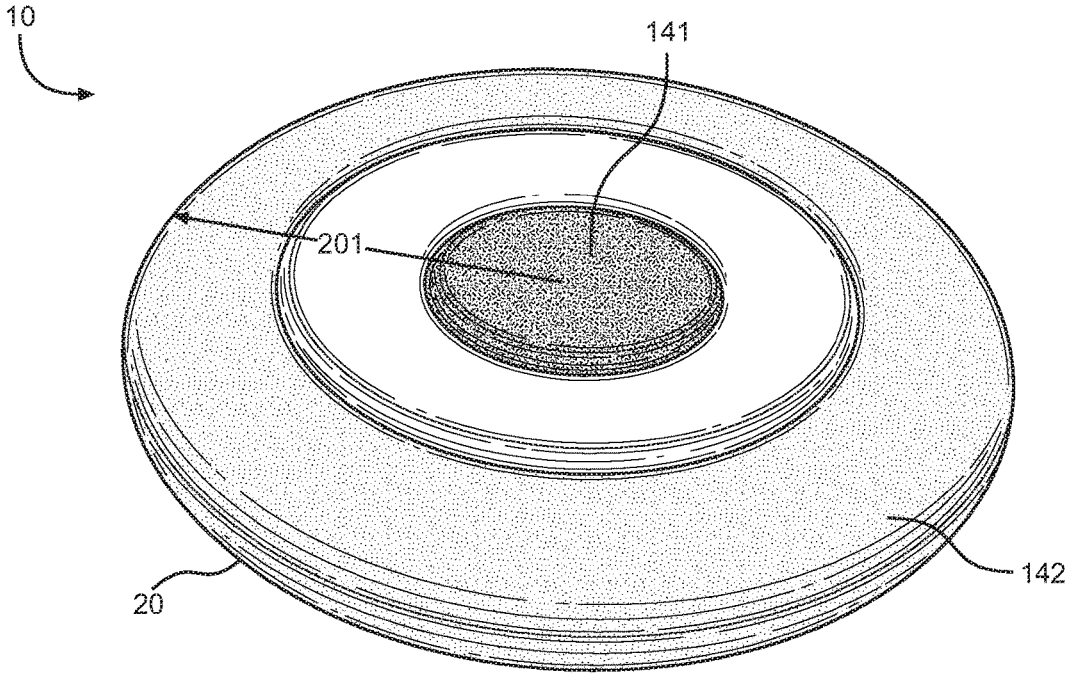
FIG. 3B shows a perspective view of an embodiment of the sensory stress relief aid as a disk pillow.

Referring to FIG. 3B, there is shown a perspective view of an embodiment of the sensory stress relief aid as a disk pillow. In a further embodiment, the sensory stress relief aid comprises a disk pillow 10 having a perimeter 20 about a circumference of the disk pillow 10. The size of the circular pillow 10 is determined by a radius 201, wherein the radius 201 is defined as the distance between a center of the disk pillow 10 and the perimeter 20.

In the shown embodiment, each surface is disposed annularly about the center of the disk pillow 10, such that the disk pillow 10 has a radial symmetry. An inner surface 141 is disposed at the center of the disk pillow 10, wherein an outer surface 142 is disposed along the perimeter 20, such that the different surfaces expand outward from the center. In this way, an individual can grasp the edge of the disk pillow 10 to experience the outer surface 142 or can lay their head atop the disk pillow 10, such that their face is flush against the inner surface 141, depending on the user's preference.

Figure 4A:
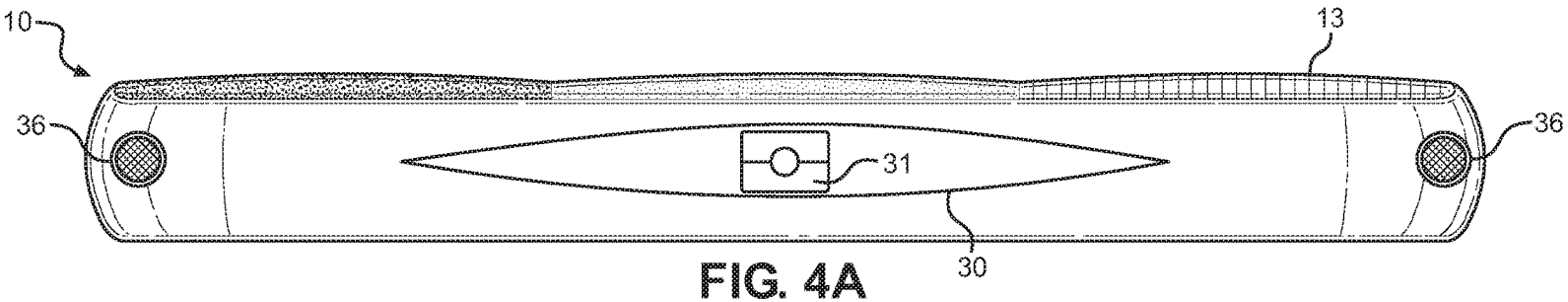
FIG. 4A shows a half section view of an embodiment of the sensory stress relief aid in a deflated position.
Figure 4B:
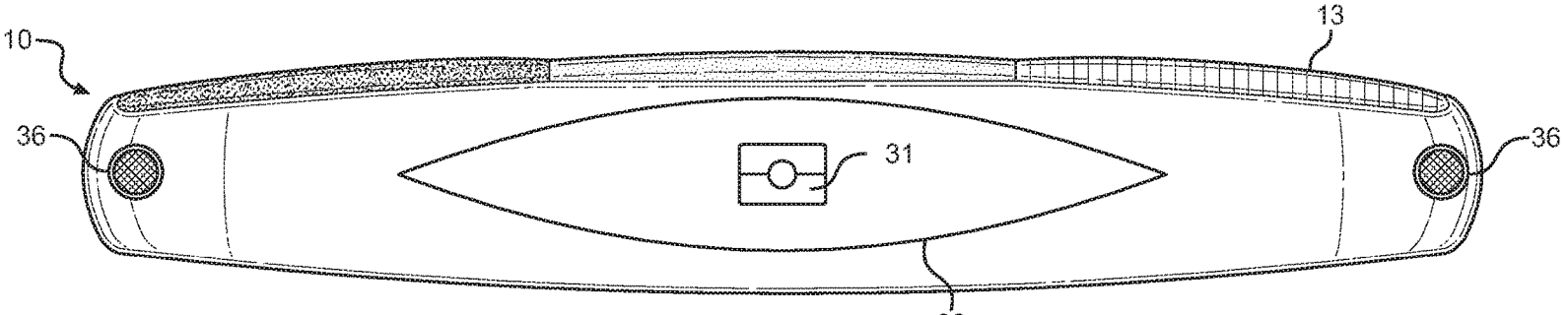
FIG. 4B shows a half section view of an embodiment of the sensory stress relief aid in an inflated position.

Referring now to FIGS. 4A and 4B, there is shown a half section view of an embodiment of the sensory stress relief aid in a deflated position and a half section view of an embodiment of the sensory stress relief aid in an inflated position, respectively. An inflatable bladder 30 disposed within the outer layer 13 is attached to, and in gaseous communication with, a motor 31. The motor is operably attached to a circuit board and power source wherein the motor is configured to alternately inflate and deflate the inflatable bladder 30 to simulate the breathing of a person and corresponding chest expansions and retractions.

At least one speaker 36 is also operably connected to the circuit board and disposed within the outer layer 13. The speakers are adapted to emit calming sounds designed to relax and destress an individual attempting to fall asleep. Programmed recordings such as guided meditation instructions and soothing white noise such as ocean waves or rain forest sounds. These programs may be stored on the circuit board and can be preloaded with the pillow 10.

Figure 5:
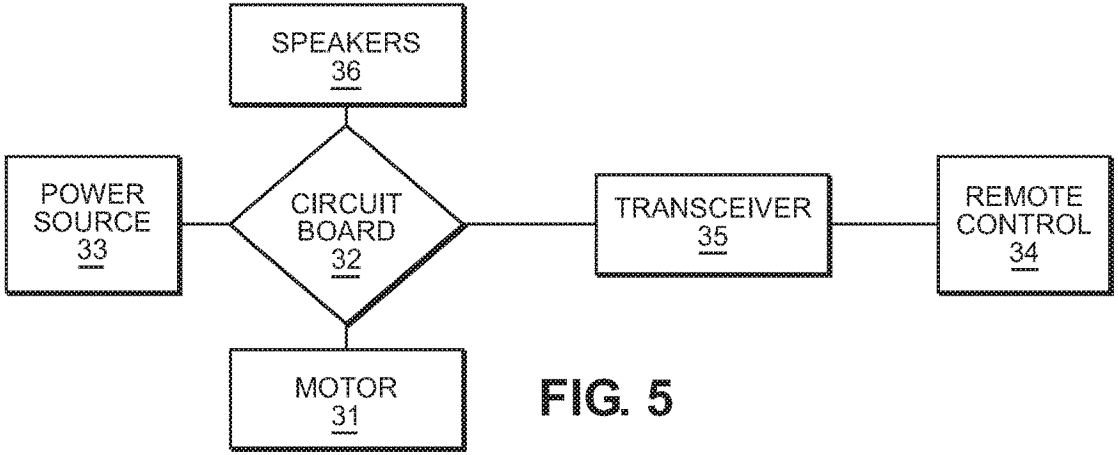
FIG. 5 shows a schematic diagram of the electronic components of an embodiment of the sensory stress relief aid in use.

Referring now to FIG. 5, there is shown a schematic diagram of the electronic components of an embodiment of the sensory stress relief aid. The motor 31 and speakers 36 may be selectively operated by a user through a remote control 34. The remote control 34 is in wireless communication with the circuit board 32 via an embedded transceiver 35 within the circuit board 32 wherein signaled commands from the remote control 34 may be processed and carried out. The power source 33 provides the necessary energy to power the motor for inflating and deflating the bladder and for the sounds and programs emitted through the speakers. In the illustrative embodiment, the power source 33 comprises a self-contained battery, but may comprise any suitable source of energy in alternate embodiments.

Figure 6:
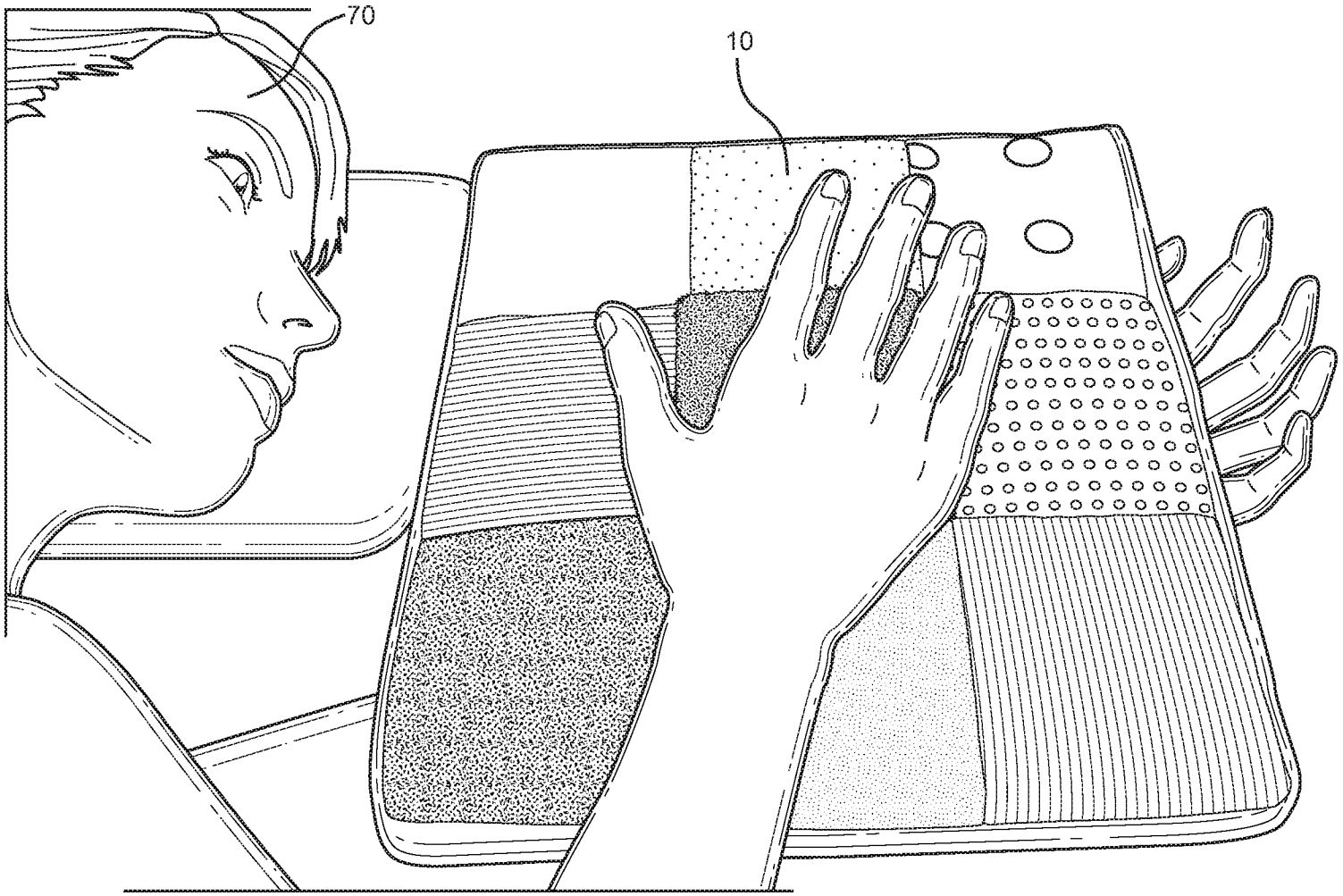
FIG. 6 shows a perspective view of an embodiment of the sensory stress relief aid in use.

Referring to FIG. 6, there is shown a perspective view of an embodiment of the sensory stress relief aid in use. In operation, a user 70 who is experiencing some form of mental distress, or who wishes to fall asleep faster, will take the sensory stress relief aid 10 to bed and lie down, placing the sensory stress relief aid 10 between their hands. In this way, the user 70 can push or touch the surface on the sensory stress relief aid 10 that helps them relieve stress. In this way, a user 70 is distracted from intrusive thoughts through sensory stimulation thereby allowing them to relax.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sensory stress relief aid, comprising:

a pillow having a length and a width defining an outer layer;

the outer layer having a plurality of different surfaces disposed thereon on an upper side and a lower side;

each surface producing a different tactile sensation;

wherein at least two surfaces of the plurality of different surfaces are made of a different material from one another;

wherein the plurality of different surfaces extends across the full width and length of the pillow such that the surfaces encompass the entire surface area of the outer layer;

a plurality of inner layers enclosed by the outer layer, each inner layer corresponding to one surface of the plurality of different surfaces, such that there are an equivalent number of inner layers which correspond to the number of the plurality of different surfaces, wherein each inner layer is defined by a perimeter contiguous with a perimeter of the corresponding one surface of the plurality of different surfaces;

a circuit board operably connected to a power source;

a motor attached to an inflatable bladder;

a remote control in wireless communication with a transceiver within the circuit board.

2. The sensory stress relief aid of claim 1, wherein the plurality of different surfaces are oriented across the outer layer in a grid like manner.

3. The sensory stress relief aid of claim 1, wherein an indicium having a corresponding surface is disposed on the outer surface of the pillow.

4. The sensory stress relief aid of claim 1, wherein the width and length are equivalent such that a square pillow is formed.

5. The sensory stress relief aid of claim 1, wherein the pillow is configured to resemble a disk.

6. The sensory stress relief aid of claim 5, wherein the plurality of different surfaces extend outward such that the surfaces are disposed along a radius of the pillow.

7. The sensory stress relief aid of claim 1, wherein the pillow is configured to resemble a cylinder.

8. The sensory stress relief aid of claim 7, wherein the plurality of different surfaces are disposed about a circumference of the cylinder.

9. The sensory stress relief aid of claim 4, wherein a spherical pom-pom is affixed to each corner of the square pillow.

10. The sensory stress relief aid of claim 9, wherein each spherical pom-pom is affixed to a distal end of a tassel having a proximal end affixed to the respective corner of the square pillow.

11. The sensory stress relief aid of claim 1, wherein the motor is configured to alternatively inflate and deflate the inflatable bladder.

12. The sensory stress relief aid of claim 11, wherein the remote control is configured to selectively operate the motor as desired by a user.

13. The sensory stress relief aid of claim 1, wherein at least one speaker is operably connected to the circuit board.

14. The sensory stress relief aid of claim 13, wherein the one or more speakers are configured to emit sounds which are stored on the circuit board.

15. The sensory stress relief aid of claim 13, wherein the remote control is configured to selectively operate the speakers and allow a user to choose between sounds emitted through the speakers as desired.

* * * * *